United States Patent [19]

Stuart et al.

[11] Patent Number: 4,602,470

[45] Date of Patent: Jul. 29, 1986

[54] DISMOUNTABLE FRAMEWORK

[75] Inventors: James E. D. Stuart; Victor W. Gower, both of Wolverhampton, Great Britain

[73] Assignee: Ponable Limited, Wolverhampton, England

[21] Appl. No.: 574,594

[22] Filed: Jan. 27, 1984

[51] Int. Cl.[4] ..... E04H 12/00

[52] U.S. Cl. ..... 52/655; 52/638; 52/648; 52/726; 182/179; 403/49

[58] Field of Search ..... 52/638, 648, 654, 655, 52/726, 126.3, 126.4, 126.6, 73, 678, 365; 403/49, 171, 176, 217; 182/178, 179

[56] References Cited

U.S. PATENT DOCUMENTS

| | | | |
|---|---|---|---|
| 325,302 | 9/1885 | Wilson | 52/165 |
| 964,233 | 7/1910 | Gilliland . | |
| 967,803 | 8/1910 | Mercer | 182/179 |
| 1,299,261 | 4/1919 | Taylor | 52/121 X |
| 2,181,784 | 11/1939 | Dugan et al. | 52/638 |
| 2,771,324 | 11/1956 | Ryder . | |
| 3,371,458 | 3/1968 | Sturgill | 52/726 |
| 3,979,864 | 9/1976 | Tillié | 52/126.4 |
| 4,173,102 | 11/1979 | Judge | 52/73 |
| 4,481,748 | 11/1984 | D'Allessio et al. | 52/638 |

FOREIGN PATENT DOCUMENTS

| | | | |
|---|---|---|---|
| 864145 | 12/1952 | Fed. Rep. of Germany . | |
| 1928717 | 9/1965 | Fed. Rep. of Germany . | |
| 1938300 | 5/1966 | Fed. Rep. of Germany . | |
| 2435250 | 4/1976 | Fed. Rep. of Germany . | |
| 722425 | 11/1977 | Fed. Rep. of Germany . | |
| 888210 | 12/1943 | France . | |
| 2473090 | 7/1981 | France . | |
| 418604 | 2/1967 | Switzerland . | |
| 468045 | 6/1937 | United Kingdom . | |
| 480912 | 3/1938 | United Kingdom | 52/165 |
| 631566 | 11/1949 | United Kingdom . | |
| 969617 | 9/1964 | United Kingdom . | |
| 1096727 | 12/1967 | United Kingdom . | |
| 1289587 | 9/1972 | United Kingdom . | |
| 1326132 | 8/1973 | United Kingdom . | |
| 1587379 | 4/1981 | United Kingdom . | |
| 2085107 | 4/1982 | United Kingdom | 52/638 |
| 2133495A | 7/1984 | United Kingdom . | |

*Primary Examiner*—Alfred C. Perham
*Assistant Examiner*—Jean M. LaKemper
*Attorney, Agent, or Firm*—C. O. Marshall, Jr.

[57] ABSTRACT

Dismountable multi-purpose framework (for example for use in forming access towers or platforms) is provided using a set of elongate members, preferably metal angle; including pillar members 10 and linking members e.g. horizontal members 11 interconnected by engaging a tenon formation 12 at one end of a first pillar member with a socket formation 16 of a second pillar member so that they are aligned in end to end relationship. The linking members have apertured lugs 21 which engage the tenon formation between the pillar members and the assembly is secured by a U bolt 17 which engages the tenon formation and is tightened by a wedge 19.

9 Claims, 15 Drawing Figures

DISMOUNTABLE FRAMEWORK

This invention relates to dismountable frameworks which may be used for a wide range of purposes in forming temporary semi-permanent and/or readily dismountable structures, particularly but not exclusively scaffolding, access towers or platforms, temporary load supports e.g. for locating concrete shuttering or other falsework used in building, constructing temporary buildings or shelters, collapsible freight containers and stillages, and the like.

In the past round section steel scaffold tubing has been almost universally employed for such purposes as the above, particularly by commercial contractors and, though in many respects this material has proved satisfactory, it does have practical disadvantages. The tubing is costly; it is heavy unwieldy and difficult to store, transport and handle particularly for small scale applications e.g. domestic use, and in large scale applications such as substantial scaffolding erections, it is not always safe and secure as joining is normally effected by clamps in frictional engagement with the tubing periphery. Insufficient tightening or failure of even a single clamp, which may be under considerable loading, can cause a chain reaction leading to collapse of the entire structure, particularly as the tubing is not normally joined in end to end relationship i.e. each joint forms a side by side connection with forces transmitted in shear through the clamp and bending and/or twisting moments being carried by the tubing.

The object of the present invention is to provide a dismountable framework which is easily and safely assembled and secured together without special skills, which is cheap and adaptable, which can be provided in a range of sizes including those suitable for domestic or "do it yourself" users and which can be transported and stored in a minimum of space, and which is particularly reliable and safe in use.

According to the invention there is provided a set of members for constructing a dismountable framework comprising a plurality of operatively vertical elongate pillar members and a plurality of elongate linking members, end portions of said members being operatively interconnected to form a framework, a first end portion of one pillar member having a longitudinally projecting tenon formation and a second end portion of another pillar member having a socket formation opening longitudinally thereof to receive said tenon formation so that said pillar members are operatively aligned in rectilinear end-to-end relationship; end portions of the linking members each including an apertured lug for engagement with said tenon between said end portions in use to locate the linking member whereby the latter member is located in a vertical plane which includes a common axis of both of said pillar members and said tenon formation.

Preferably the second end portion is provided with securing means comprising a retaining member displaceable laterally of said end portion to engage the periphery of the inserted tenon formation.

An embodiment of the invention with certain variations and modifications is now more particularly described with reference to the accompanying drawings, wherein.

Figure 6:
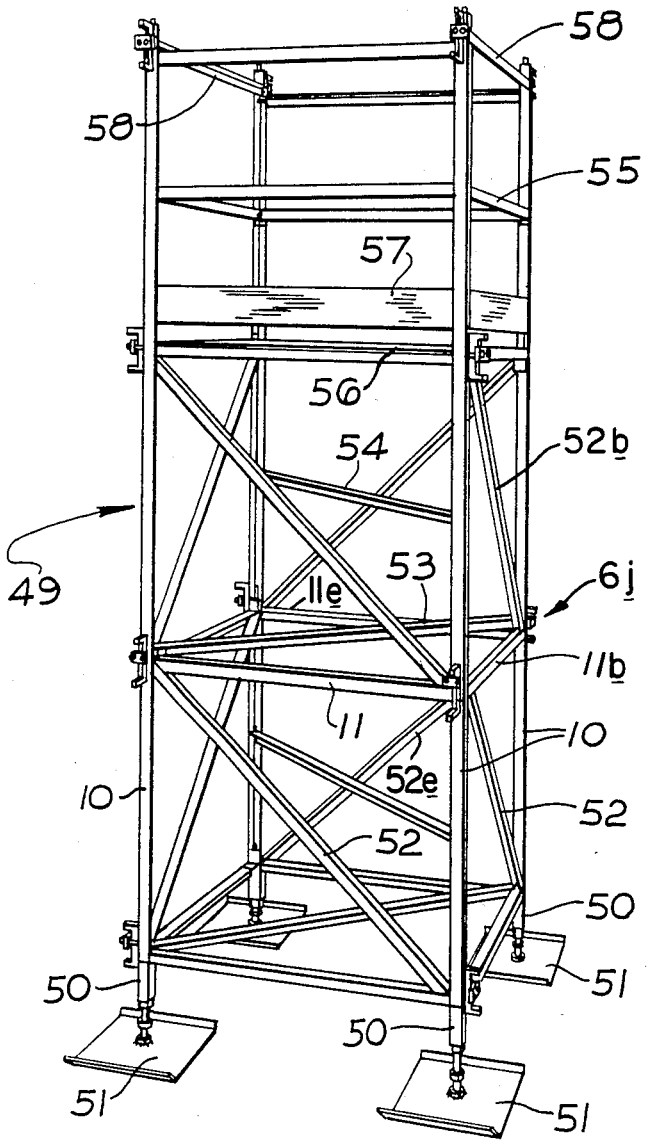
FIG. 6 is a perspective diagram of an access tower.
Figure 8:
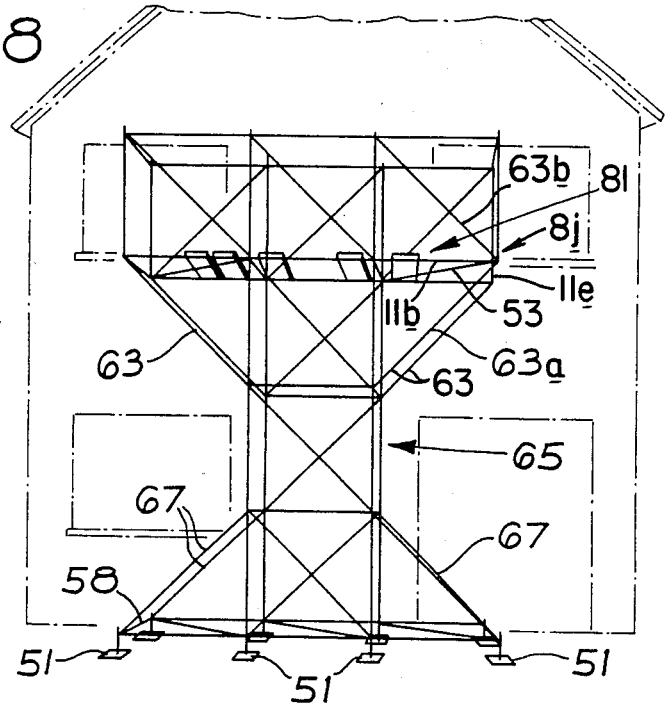
Figure 14:
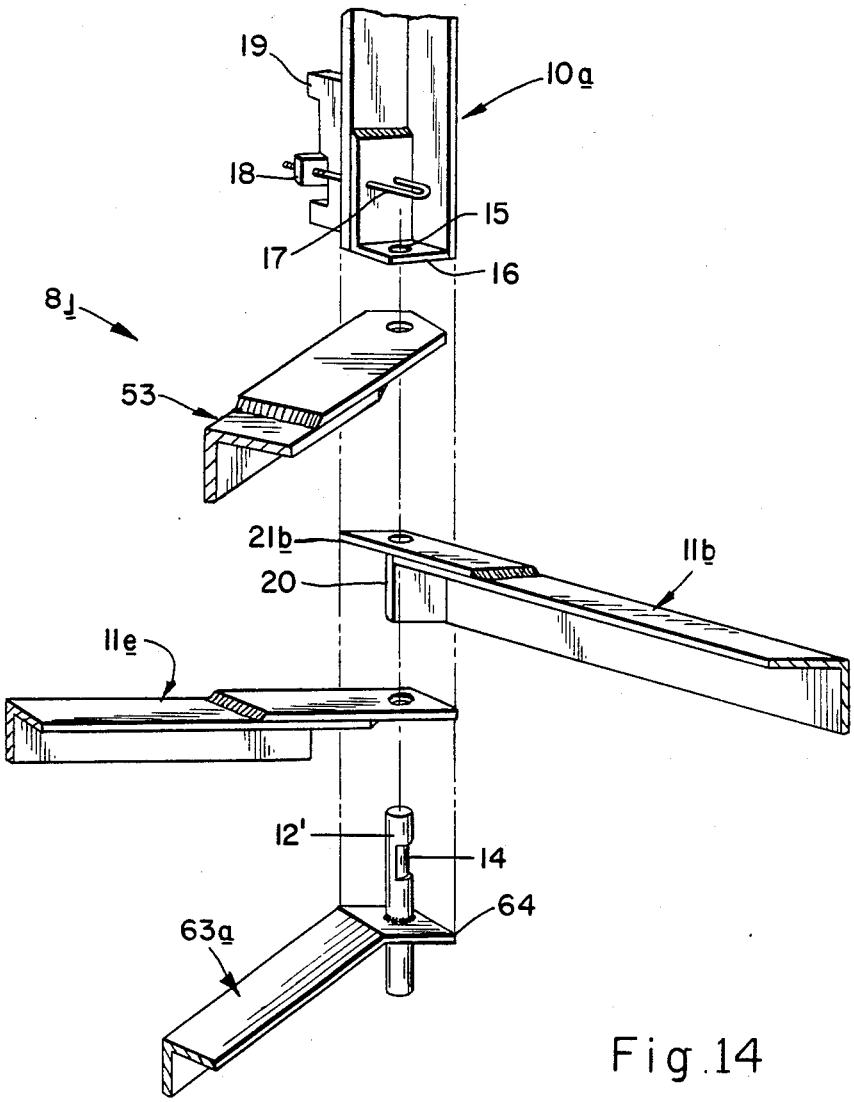
Figure 15:
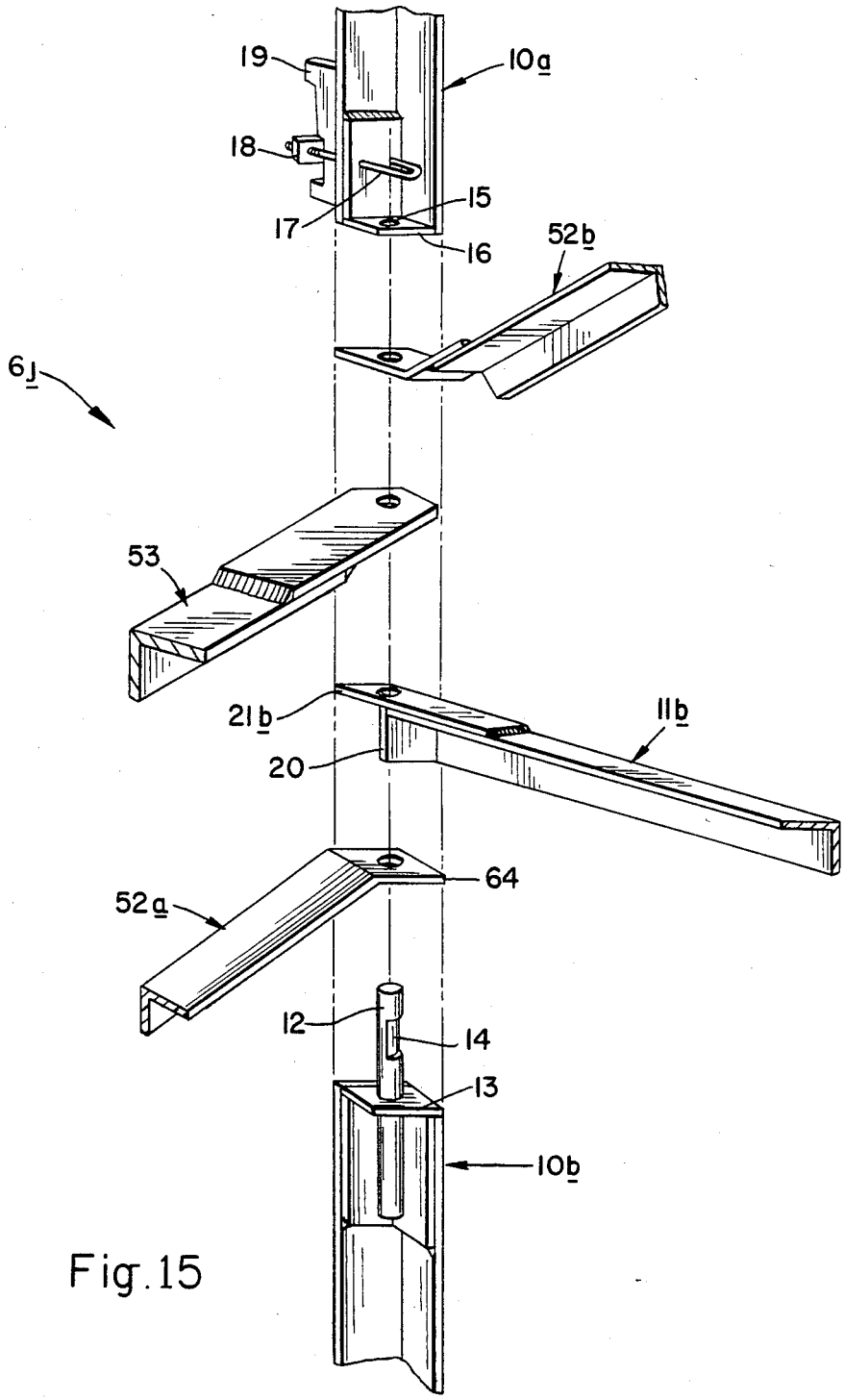

FIGS. 14 and 15 are exploded perspective views of joint 8*j* in FIG. 8 and joint 6*j* in FIG. 6, respectively.

Figure 1:
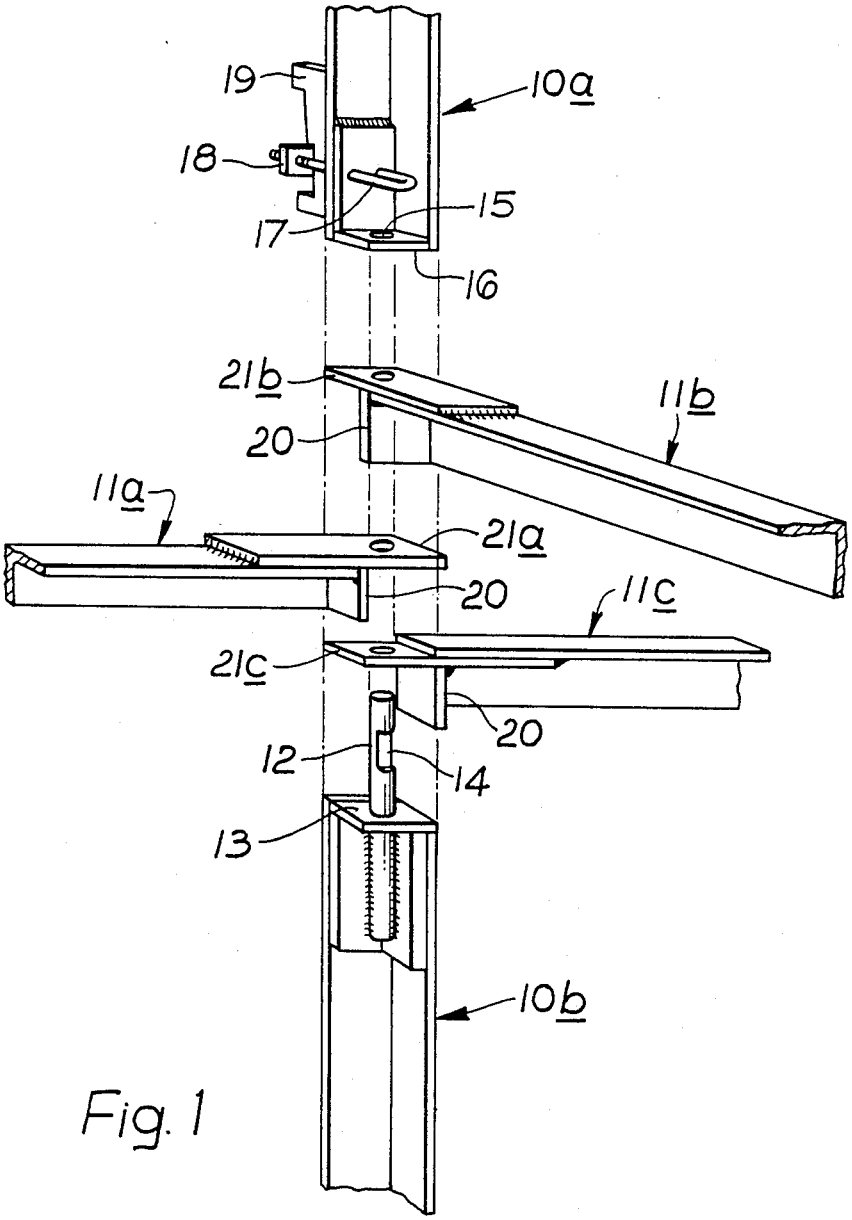
FIG. 1 is an exploded perspective view of part of a rectilinear framework.
Figure 2:
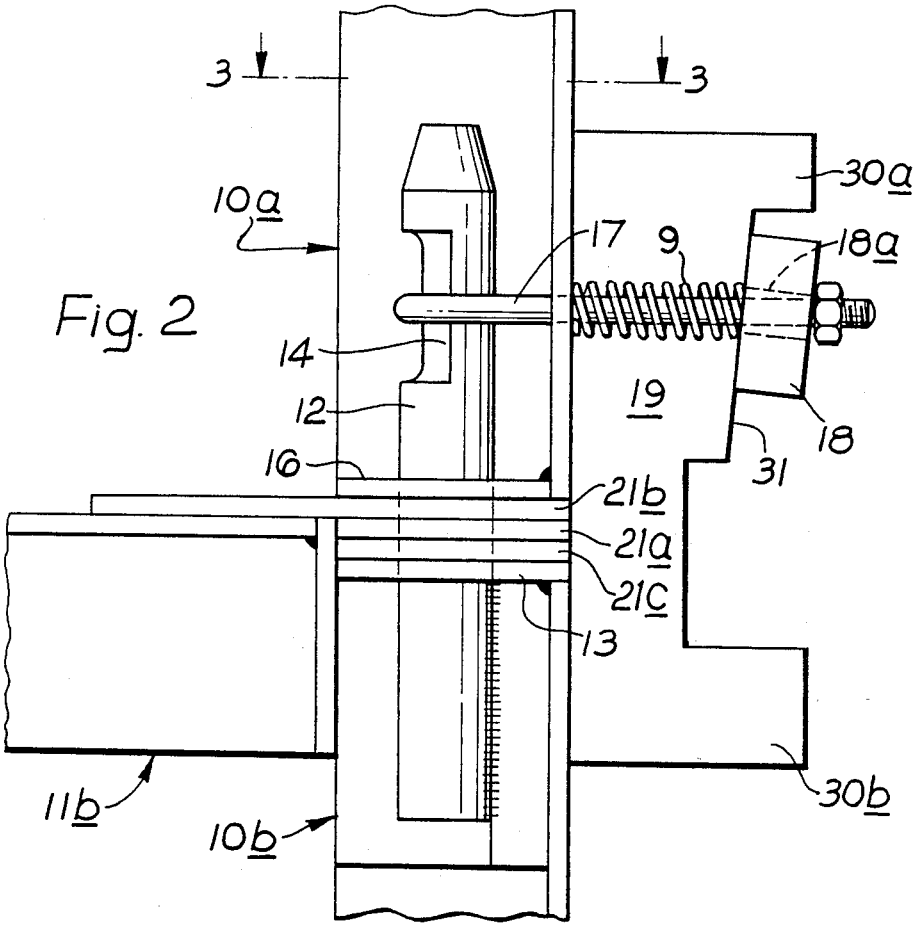
FIG. 2 is an elevation of an assembled joint of the framework.
Figure 3:
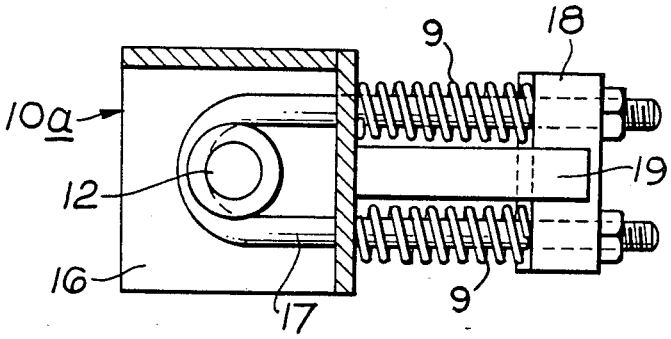
FIG. 3 is a sectional plan view on line 3—3 of FIG. 2.

A set of members for constructing a light duty rectilinear framework for use as scaffolding or the like, will first be described. The dismountable members in the example shown in FIGS. 1 to 3, are of two kinds; vertical or pillar members 10 and linking members in the form of horizontal or cross members 11, major elongate parts of all of which consist of standard L section steel angle and having means for interconnection at each end thereof. For light duty applications such as a small domestic access platform e.g. for use on a staircase or for constructing a work bench or the like each member can be an effective length of 75 cm for ease of handling and storage and the angle section could be 2.5 cm. Wider and heavier section may be used e.g. 40 mm angle section in 3 mm gauge metal for heavy duty frameworks and longer members may be employed in some circumstances.

In FIGS. 1 to 3 only the lower end of an upper pillar member 10*a* and the upper end of a lower such member 10*b* is shown together with one end only of three cross members 11*a, b, c* to connect with the pillar members at right angles.

Each pillar member 10 has a first operatively upper end portion forming a male connection by having a longitudinally extending tenon 12 welded to a block or distance piece between the inner faces of the angle webs and projecting centrally through a square end abutment plate 13 which is also welded to said webs. In this example tenon 12 is a circular section steel peg having a flat or notch 14 on one side partway along its free length.

The second operatively lower end portion of each pillar member 10 forms a female connection including a socket formation defining a mortice aperture 15, in this example a circular bore in the centre of a square end abutment plate 16 welded to the webs of the angle section.

The latter end portion is also provided with securing means comprising a stirrup member in the form of a U bolt 17 located in a pair of bores in one web of the angle so as to provide a loop within the angle which embraces tenon 12 when the latter is inserted into mortice 15. The outer ends of U bolt 17 mount a cross piece 18 permitting its effective length to be selectively adjusted and a captive wedge 19 acts between the outer face of the associated angle web and cross piece 18 to draw the U bolt 17 into tight positive engagement with the notch 14 of tenon 12 to secure the assembly.

In the above manner a pillar of any desired length can be built up using successive pillar members 10 and these are secured in aligned end-to-end relationship so that down thrust is transmitted directly along their length. It will be observed that the inherent weight-bearing ability of a pillar so formed does not in any way depend on the security or clamping engagement of the securing means with the tenons 12, indeed for some applications securing means may not be necessary.

Each cross member 11 is formed from standard L-section steel angle generally as described with reference to members 10 and both end portions of each cross member comprise a welded on end abutment plate 20 and an apertured lug 21 projecting longitudinally beyond plate 20, this lug being welded to the upper horizontal web of the angle either below (21*c*) or above (21*a, b*) the latter.

Where cross members are to be joined to the assembled pillar their lugs 21 are positioned on tenon 12 in sequence e.g. as illustrated in FIGS. 1 to 3 where a three-way connection is shown, before the tenon is engaged with the next upper pillar member 10*a*.

Figure 4:
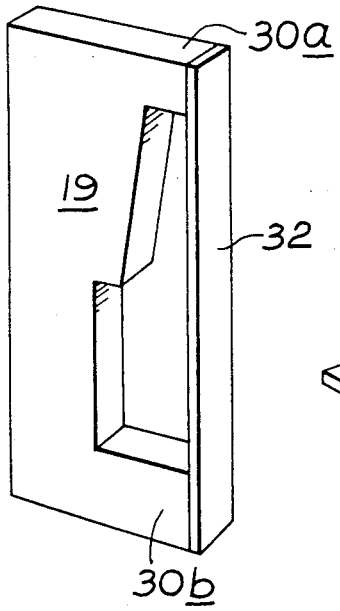
FIG. 4 is a perspective view of a modified form of wedge.

The wedge 19 is formed from flat plate and, as best shown in FIG. 2, has one edge cut out to form a notch between upper and lower end stops 30*a*, 30*b* which retain the wedge captive with the U bolt 17. An upper part of the notch includes an inclined edge face 31 enabling the U bolt to be tightened by driving the wedge downwards to react with cross piece 18, elongated slots 18*a* in the latter permitting it to tilt on bolt 17. The lower part of the notch is deeper and not inclined to permit compression of the springs 9 to provide maximum inward movement of the U bolt for freeing the tenon 12. In a modification shown in FIG. 4 the end stops 30*a*, 30*b* are bridged by a bar 32 integral with or welded onto said stops, so strengthening the wedge and making its captive retention on cross piece 18 more positive.

Wedge 19 is preferably distinctively coloured so that a very quick visual inspection of the assembled framework will show whether it has been tightened into place (or has become loosened or displaced in service). In any event the wedge will tend to drop to the secured position in use which will retain the tenon automatically even if the wedge has not been fully tightened and, as explained above, the integrity of the structure does not depend on this tightening, downward loading on the cross members 11 and/or upper pillar member 10*a* is transmitted directly to the top of pillar member 10*b* and lateral forces on the latter are transmitted from members 11 directly to the tenon 12, the securing means carries none of these forces.

Instead of the adjustable U bolts 17 a simple link or hook-shaped bar, or a screw clamp, could serve as a retaining member of the securing means, and it will also be appreciated that various forms of mortice and tenon could be employed though for ease of manufacture and availability of material, the round peg and circular apertures are preferred. Thus, oval, square or rectangular section mortices and tenons or other configurations might be employed in some applications and the section and shaping of the members themselves can be widely varied.

Figure 5:
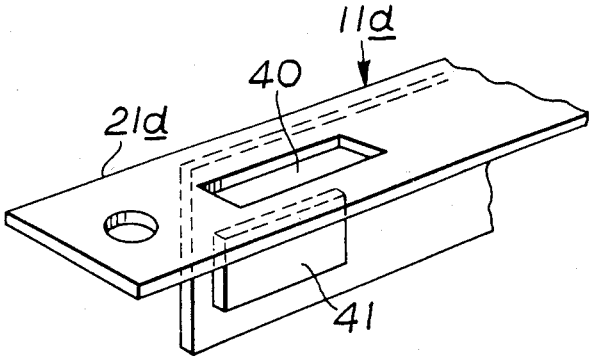
FIG. 5 is a perspective view of an end portion of a further form of cross member.

For some forms of framework a fourth horizontal cross member may be required to connect with the pillar assembly shown in FIGS. 1 to 3. FIG. 5 shows an end portion of a fourth cross member 11*d* which can be connected at right angles to members 11*a*, 11*c* to form a continuation of member 11*b*. This member has an apertured lug 21*d* to engage tenon 12, and a slot 40 cut out of its upper web to provide clearance for the wedge 19. A pad 41 is welded to the vertical web of member 11*d* in the region of slot 40 for reinforcement.

The strength and stiffness of the framework can be added to by use of diagonal bracing to form a triangulated rectilinear structure and FIGS. 6 to 9 are perspective diagrams of four examples of the many forms of structure which can be provided using the invention.

Figure 10:
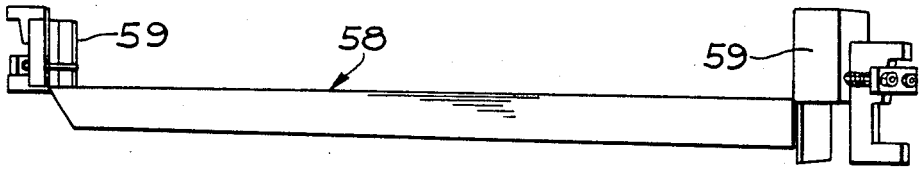
FIGS. 10, 11, 12 and 13 are perspective views of respective additional members for use with the invention.
Figure 12:
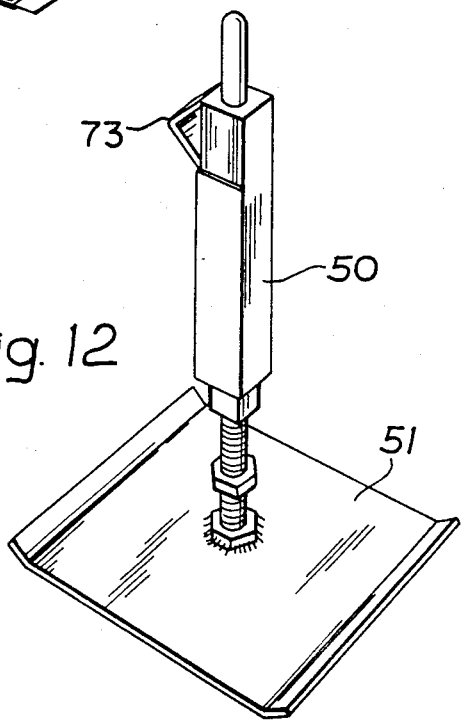

FIG. 6 shows a simple free-standing access platform or tower 49 using four pillar assemblies made up of sets of pillar members 10. The lowest portions of these assemblies are short pillar members 50 provided with adjustable levelling feet 51 shown in detail in FIG. 12. Each side frame of the tower includes horizontal members 11 and is braced in the vertical plane by diagonal sloping linking members 52 extending from the tenon at the lower end of a lower pillar member to that at the upper end of the parallel pillar member on that side, members 52 having angled lugs at each end for this purpose. Additional rigidity is provided by horizontal diagonal linking members 53 (see FIG. 14) connecting opposite corners of the frame, and the pillar members in this example are also provided with intermediate attachment points within the web angle to receive further horizontal cross braces 54 or, at the top level, horizontal members 55 forming a safety rail around a deck 56. Toe boards 57 are also shown. A pair of horizontal locking members 58, shown in detail in FIG. 10 are used to finish off the tower these having short pillar members 59 at each end at right angles to the length of the member with securing U bolts and wedges to engage the uppermost tenon formations of the pillar assemblies.

Figure 7:
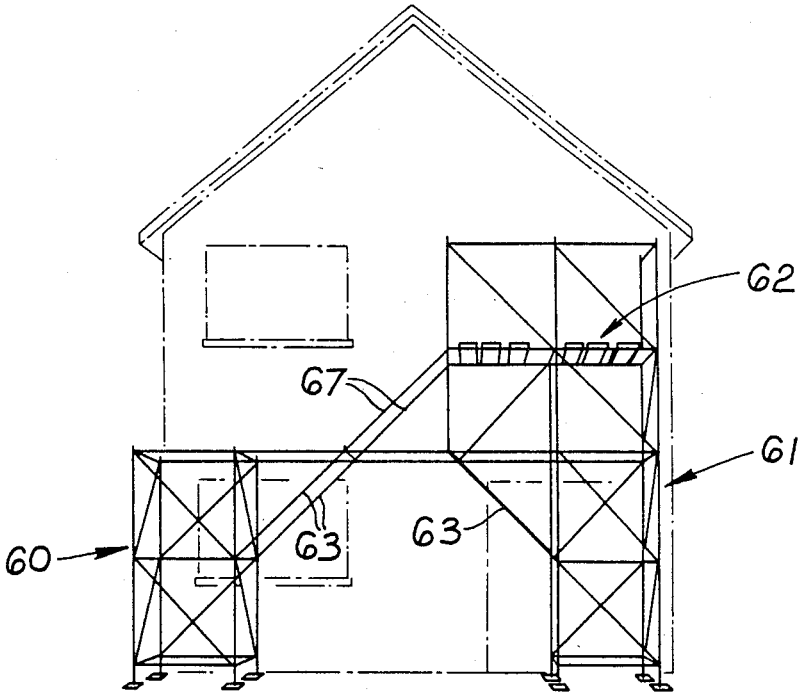
FIGS. 7, 8 and 9 are perspective diagrams of examples of other structures utilising the invention.
Figure 9:
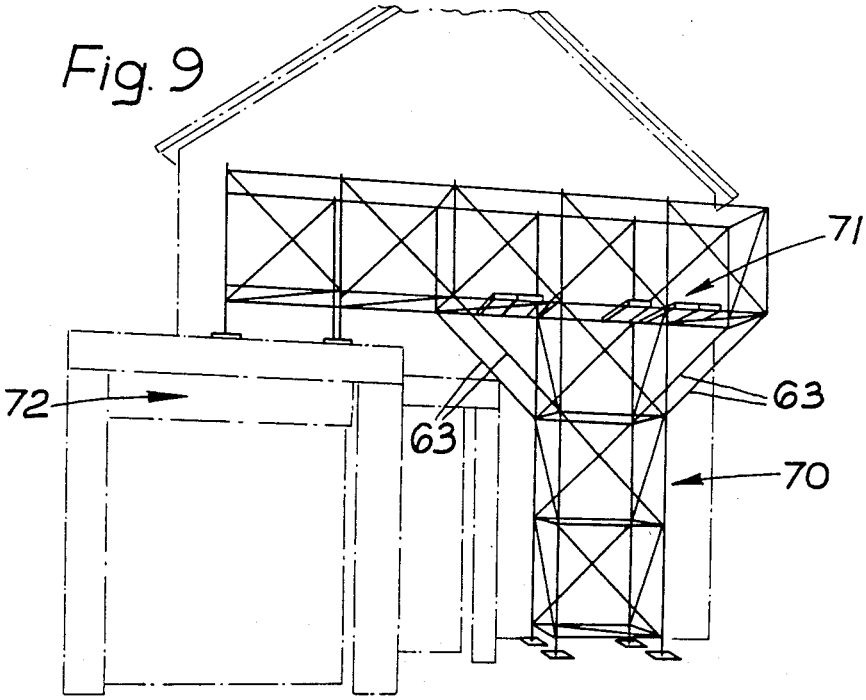

FIGS. 7, 8 and 9 are diagrams of three of many and varied forms of framework structures which may readily be assembled using the invention.

Figure 11:
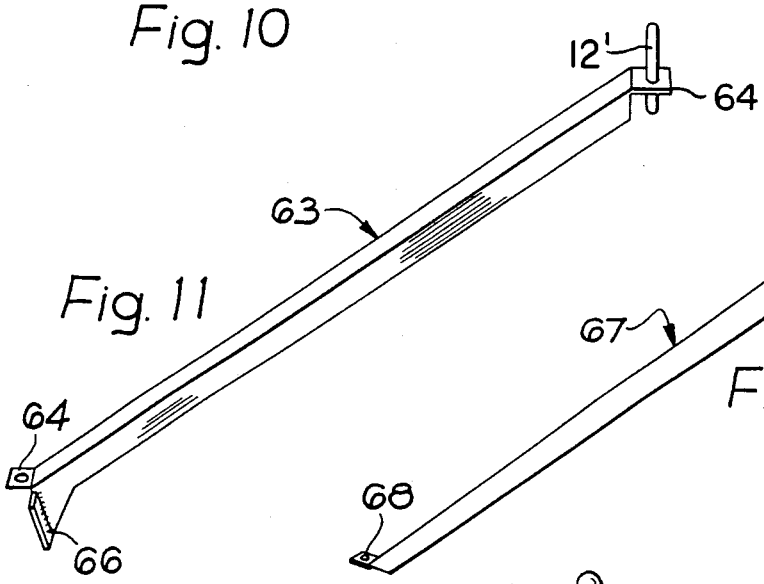

FIG. 7 shows the bridging of a substantial span between two spaced towers 60, 61 similar to those shown in FIG. 6, the righthand tower 61 being extended upwards to a working platform 62, for example at second floor window level. To add to the support of the horizontal span of this structure a further form of member is used, a diagonal cantilever member 63 (see FIGS. 11 and 14). This member has a lug 64 angled to be horizontal at its lower end and a tenon 12' (as on the pillar members) angled to be vertical at its upper end to receive other members. To add to its rigidity the lower end is also provided with a downward-extending abutment 66 having a vertical face to locate against a face of the adjoining pillar member.

Figure 13:
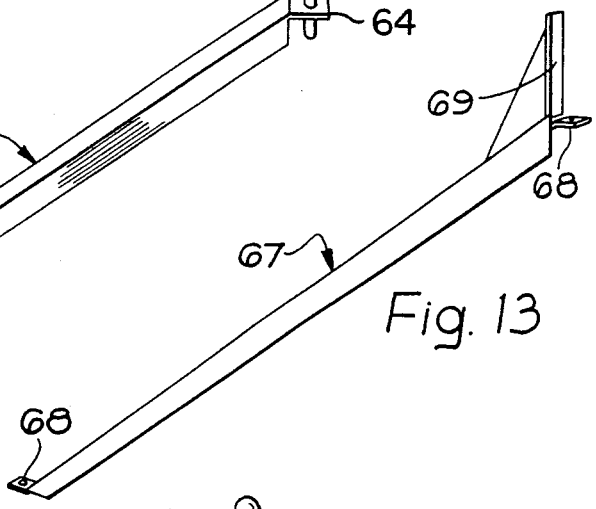

Also shown is a diagonal outrigger or buttress member 67 (see FIG. 13) having angled lugs 68 at each end which extend horizontally in use to connect with respective tenon formations at different levels. Member 67 has an upwardly extending abutment 69 at its upper end with a vertical face to locate against a face of the adjoining pillar member.

In FIG. 8 a free standing tower framework 65 is shown with a work platform 81 at second story level cantilivered outward from opposite sides of the main tower using cantilever members 63, stability and support being provided by ground engaging feet 51 mounted on outriggers below the cantilevered parts of platform 81, the outriggers using buttress members 67 assembled with pillar members 50 of feed 51 having side brackets 73, and being secured by locking members 58.

FIG. 9 shows another form of framework 70 providing a longer work platform 71 at high level using cantilever members 63, one end of the platform being supported on the roof of a single story building 72.

FIG. 14 is an exploded perspective view of the joint 8*j* in FIG. 8. The members which are connected at this joint include the horizontal diagonal member 53, the horizontal members 11*b* and 11*e* and the diagonal member 63*a*. For the sake of simplicity, the third diagonal member 63*b* is not shown in FIG. 14.

FIG. 15 is an exploded perspective view of the joint 6*j* in FIG. 6. The members which are connected at this joint and include the horizontal diagonal member 53, the horizontal member 11*b* and the diagonal members 52*a* and 52*b*. For the sake of simplicity, the horizontal member 11*e* (shown in FIG. 14) is not shown in FIG. 15.

The different types of member may each be distinctively coloured to facilitate assembly and diagrams of common types of assembly listing the members required to build it may be provided. It is contemplated that such diagrams and listing might be provided for standard or for special purpose structures using a computer which will also be programmed to provide calculations of safe working loading, and, if required, costing of the members needed either on a purchase or hire basis.

Using such a diagram the structures can be safely and reliably assembled even by unskilled or inexperienced labour, e.g. for "do it yourself" repairs or maintenance by householders themselves. As the structure is self-supporting and positively locating from the ground up it can be safely stood on and climbed up as erection proceeds.

The use of members to make up each side of a rectilinear triangulated framework or truss whose loads are transmitted in a common vertical plane along their axes, and the manner in which the loads are all carried to the axially centred tenons without reliance on the integrity of securing or fastening means or application of off-centre loadings thereto as is the case when tubular or other members are secured side by side enables stable free standing structures to be provided avoiding the need in many cases to "tie" them in to a building, and the ability to construct simply and safely cantilevered or bridging structures over a wide span means that access to many locations otherwise awkward to get to can be readily provided, and that room can be left at ground level for work and for unobstructed and safe passage e.g. along pavements or footways or to the doors or shop windows of a building being worked on.

Different weights or gauges of member may be employed in the same structure, for example a heavier gauge pillar member could be used in the lower parts of a tall tower or scaffolding or for the formation of a hollow girder or cantilever platform to span a substantial distance. Additional members can be purchased and added onto an existing system as required and it is anticipated that there will be considerable cost saving over conventional tubular scaffolding and clamps, for example steel angle equivalent in service to standard scaffold tubing costs, by weight, less than half the price of the latter and is in any event much lighter in weight for a given length. 40 mm angle of 3 mm gauge steel weighs 1.81 Kg per metre length while the same length of standard steel scaffold tube weights about 3 Kg. and will not withstand the same loading.

Other members and accessories including special purpose fittings can be incorporated in the set of members or adapted to interconnect therewith, for example access ladders or steps, telescopic legs or pillars, ground engaging wheels for moveable towers, staging or stillages, hoists or lifts for materials, doors or shutters for collapsible transport or storage racks or container frames, conveyor tracks etc.

Distal portions of the tenons 12 may each be provided with a through cross-bore to receive a securing bolt or lock e.g. to prevent unauthorised dismantling or tempering with an assembled structure.

We claim:

1. A dismountable framework for supporting a working platform at a sutstantial height above ground level, constructed of L-section metal angle members, comprising (a) a plurality of operatively vertical pillars, each comprising a plurality of elongated L-section angle members, each of said angle members having at one end a tenon secured in an inner corner and projecting beyond the end of said angle member, and having at its other end a socket which is coaxial with said tenon and into which fits the tenon of an adjacent angle member, to connect two adjacent angle members in rectilinear load-bearing relationship, (b) a retaining member which acts laterally upon said connecting tenon to secure it against withdrawal irom said socket and thus secure together said two connected adjacent angle members, and (c) a plurality of operatively non-vertical elongated L-section angle members linking said pillars to form a framework, each of said linking members having at each end a lug projecting beyond the end of said angle linking member, and each of said lugs having an aperture which fits around a connecting tenon in one of said pillars, said retaining member being a stirrup member having means for tightening it into locking engagement with the tenon.

2. A framework as in claim 1 wherein the tenon has a notch with which the stirrup member engages in use.

3. A framework as in claim 1 including at least two linking members having apertured lugs engageable with a common tenon.

4. A framework as in claim 1 wherein the linking members include at least one cross member which is horizontal in use having apertured lugs at each end for engagement with tenons of respective spaced parallel pillar members to provide a rectilinear framework.

5. A framework as in claim 4 wherein the linking members further include at least one diagonal member which is sloping in use having an apertured lug disposed at an angle at the operatively upper end for engagement with the tenon at the upper end of one of a pair of parallel spaced pillar members in use and an apertured lug disposed at an angle at the operatively lower end for engagement with the tenon at the lower end of the other of said pair in use to provide a triangulated rectilinear framework.

6. A framework as in claim 1 including at least one buttress member having apertured lugs at operatively lower and upper ends angled to be horizontal in use whereby the lower end is operatively below and offset horizontally from the upper end in use.

7. A framework as in claim 1 wherein the tenon is secured in the upper end of each pillar angle member.

8. A framework as in claim 1 wherein the linking members include at least one diagonal member which is horizontal in use, and the framework comprises at least four horizontally spaced sets of interconnected pillar members forming corners of said framework, said diagonal member having an apertured lug at each end which engages tenons of two of the sets of pillar members at diagonally opposite corners of said framework.

9. A framework as in claim 1 wherein the tightening means is a wedge.

* * * * *